US010350770B1

(12) United States Patent
Chen

(10) Patent No.: US 10,350,770 B1
(45) Date of Patent: Jul. 16, 2019

(54) PATTERN KNIFE ASSEMBLY

(71) Applicant: EVERGOOD HARDWARE PRODUCTS CO., LTD., Nantou County (TW)

(72) Inventor: Chen-Fen Chen, Nantou County (TW)

( * ) Notice: Subject to any disclaimer, the term of this patent is extended or adjusted under 35 U.S.C. 154(b) by 0 days.

(21) Appl. No.: 15/917,822

(22) Filed: Mar. 11, 2018

(51) Int. Cl.
*B26B 9/00* (2006.01)
*B26B 3/02* (2006.01)
*B25G 3/02* (2006.01)

(52) U.S. Cl.
CPC ..... *B26B 9/00* (2013.01); *B25G 3/02* (2013.01); *B26B 3/02* (2013.01)

(58) Field of Classification Search
CPC ..... B26B 9/00; B26B 3/02; B25G 3/02
USPC ..... 30/342, 343, 344
See application file for complete search history.

(56) References Cited

U.S. PATENT DOCUMENTS 56,099 A * 7/1866 Robinson
79,061 A * 6/1868 Fisher
229,219 A * 6/1880 Wilson
769,220 A * 9/1904 Hodges et al.
778,860 A * 1/1905 Hodges et al.
1,043,699 A * 11/1912 Hoppe ..... B25G 1/04 132/76.5
4,387,510 A * 6/1983 Hashemifard ..... B26B 23/00 30/309
4,399,611 A * 8/1983 Maringer ..... B26B 9/00 228/162
5,131,152 A * 7/1992 Wordtmann ..... B26B 3/00 30/344
5,155,913 A * 10/1992 Marttiini ..... B25G 3/34 30/342
6,625,890 B2 * 9/2003 Hufnagel ..... B24D 15/08 30/344
8,635,782 B2 * 1/2014 Russell, III ..... B26B 3/00 30/340
2003/0101597 A1 * 6/2003 Chen ..... B25G 1/102 30/342
2003/0101598 A1 * 6/2003 Chen ..... B25G 3/00 30/342

(Continued)

FOREIGN PATENT DOCUMENTS

CN 108582167 A * 9/2018
EP 0 520 206 A1 * 3/1992
JP 2007-61944 * 2/2007

OTHER PUBLICATIONS

English Translation of CN 108582167, Sep. 2018.*

*Primary Examiner* — Hwei-Siu C Payer

(57) ABSTRACT

A pattern knife assembly includes: a blade portion formed by forging and having a rear end integrally formed with a connecting sleeve, and a sheathing hole formed at a rear end of the connecting sleeve; and a tang portion formed by a casting or cutting process and having a tang hidden in a handle and integrally formed with a connector at the front end of the tang. The connector of the tang portion is inserted into the sheathing hole of the connecting sleeve of the blade portion and the connecting sleeve is welded to the connector, so that the connecting sleeve covers the connector and is exposed from the front end of the connecting sleeve to achieve the effects of combining the blade with the tang securely, providing a manufacturing process suitable for mass production, and showing the grain of the pattern steel in the exposed steel portion.

10 Claims, 3 Drawing Sheets

(56) References Cited

U.S. PATENT DOCUMENTS

2006/0117576 A1* 6/2006 Demers ..... B25G 1/102
30/340

* cited by examiner

PATTERN KNIFE ASSEMBLY

BACKGROUND OF THE INVENTION

Field of the Invention

The present invention relates to a pattern knife, in particular to a pattern knife assembly applied to a cooking knife, a collection knife or a knife of any other purpose.

Description of Related Art

In general, most of the conventional cooking knives, collection knives or knives of other purposes come with a structure of a blade and a tang manufactured by a low temperature forging process. In the knives forged by a pattern steel (such as Damascus steel), products of these knives have a unique grain (pattern) on the surface of the steel material, so that the knives have a special texture. However, the tang portion in the structure of the blade and tang integrally forged and formed by the pattern steel makes the manufacturing process more complicated. In addition, the material cost of the pattern steel is relatively higher, and thus is not conducive to mass production and unable to lower the manufacturing cost.

Therefore, the blade and tang are manufactured separately for the mass production of the pattern knives, wherein the blade portion adopts a sheet-shaped blade manufactured by the conventional low temperature forging process, and the tang is manufactured by a casting or cutting process, and then the rear end of the blade is welded and combined with the front end of the tang. After the blade is milled to form the structure of a tip, a cutting edge, etc., the tang is assembled to a handle to form the steel knife. Since the conventional blade is directly welded into a strip groove at the front end of the tang, the assembled and welded structure is usually not strong enough, and the blade may be bent or broken at the welded portion easily when the knife is used.

In addition, the full-keel tang structure often has a wider bolster at the front end of the tang, and the blade forged by the pattern steel is welded to the front end of the bolster, and then two grips are combined with both sides of the tang at the rear end of the bolster, and this bolster will become an exposed steel portion after the steel knife is manufactured and will be situated at the front end of the handle. On the other hand, the tang is manufactured by the forging or cutting process which is suitable for mass production, so that the portion of the bolster has no grain formed on the surface forged by the pattern steel, and the effect of extending the pattern steel integrally to the bolster cannot be achieved.

Therefore, it is an important subject for this invention to find a way of combining the forged blade securely with the tang manufactured by other processes while allowing the bolster at the front end of the tang to show a surface grain of the pattern steel.

SUMMARY OF THE INVENTION

In view of the aforementioned drawbacks of the prior art, the inventor of the present invention based on years of experience in the related industry to conduct extensive research and experiment and finally developed a pattern knife assembly in hope of achieving the effects of combining the blade with the tang more securely, providing a manufacturing process suitable for mass production, and showing the grain of the pattern steel at the exposed steel portion.

Therefore, it is a primary objective of the present invention to provide a pattern knife assembly, wherein the rear end of a blade portion is sheathed and welded to the front end of a tang portion to achieve the effects of combining the blade with the tang more securely, providing a manufacturing process suitable for mass production, and showing the grain of the pattern steel in the exposed steel portion.

To achieve the aforementioned and other objectives, the present invention provides a pattern knife assembly comprising: a blade portion, having a sheet blade, and integrally coupled to a connecting sleeve at the rear end of the blade, and a sheathing hole concavely formed in the direction from the rear end of the connecting sleeve to a tip of the blade; and a tang portion, having a tang hidden in a handle, and integrally coupled to a connector at the front end of the tang, and the connector having a width greater than the tang; and the connector of the tang portion being inserted into the sheathing hole of the connecting sleeve, and the connecting sleeve and the connector being welded to each other, and the connecting sleeve being coupled to the front end of the handle.

In the aforementioned pattern knife assembly, the connecting sleeve has an upper side and a lower side, and a cross slot is formed and extended in a direction from the rear end of the connecting sleeve to the tip of the blade for dividing the connecting sleeve into left and right sleeve plates, and the sheathing hole is formed between the left and right sleeve plates, and the connector of the tang portion is inserted into the sheathing hole between the left and right sleeve plates, and the left and right sleeve plates are welded to the connector.

In the aforementioned pattern knife assembly, the tang of the tang portion is a sheet, and the connector of the tang portion is a section which is a same block of the section of the sheathing hole.

In the aforementioned pattern knife assembly, the left and right sleeve plates are bent into symmetrical arc plates, and the sheathing hole is formed into an arc inner hole wall, and both sides of the connector of the tang portion are configured to be corresponsive to the arc sides of the inner hole wall of the sheathing hole respectively.

In the aforementioned pattern knife assembly, the handle includes two grips for clamping both sides of the tang, and the front end of the two grips abuts the rear of both sides of the connector and the rear side of the connecting sleeve.

In the aforementioned pattern knife assembly, the blade portion has a blade surface with a pattern formed thereon, and the pattern is distributed on an outer surface of the connecting sleeve.

With the technology of the pattern knife assembly of the present invention, a knife embryo can be produced quickly and the assembly can be assembled securely by the welded structure of the connecting sleeve at the rear end of the blade portion and the connector at the front end of the tang portion, and the connector is inserted into the sheathing hole at the rear end of the connecting sleeve. With the technology of the aforementioned assembly, the blade portion can be extended to a surface of the connecting sleeve due to the surface grain (such as Damascus pattern) of the pattern steel formed by the forging process (or any other manufacturing process), so that the surface pattern can be shown completely on the surface of the connecting sleeve in 360 degrees, and the steel portion (particularly the bolster portion) of the whole steel knife exposed from the handle shows the surface grain of the pattern steel.

DESCRIPTION OF THE INVENTION

The aforementioned and other objects, characteristics and advantages of the present invention will become apparent with the detailed description of the preferred embodiments and the illustration of related drawings as follows.

Figure 1:
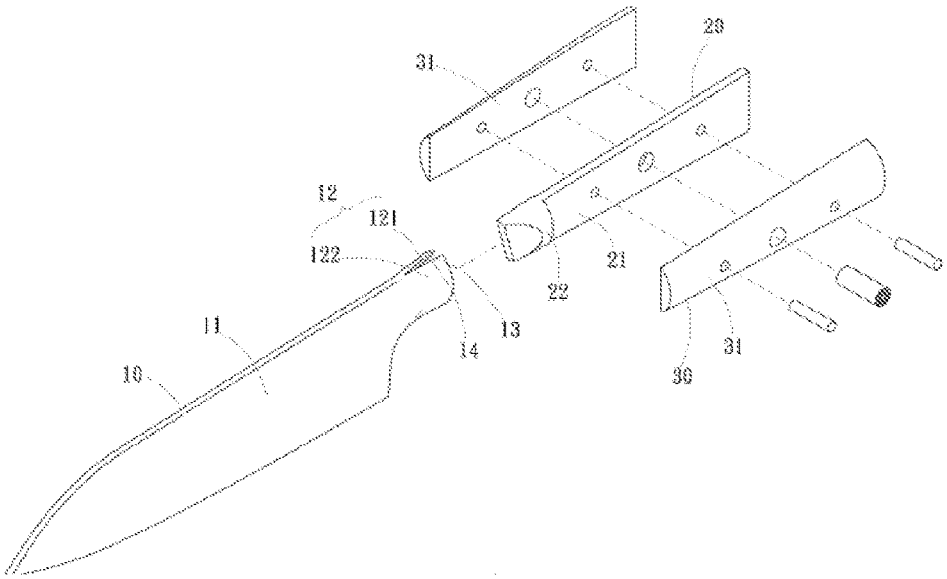
FIG. 1 is a front exploded view of a pattern knife assembly in accordance with a preferred embodiment of the present invention.
Figure 2:
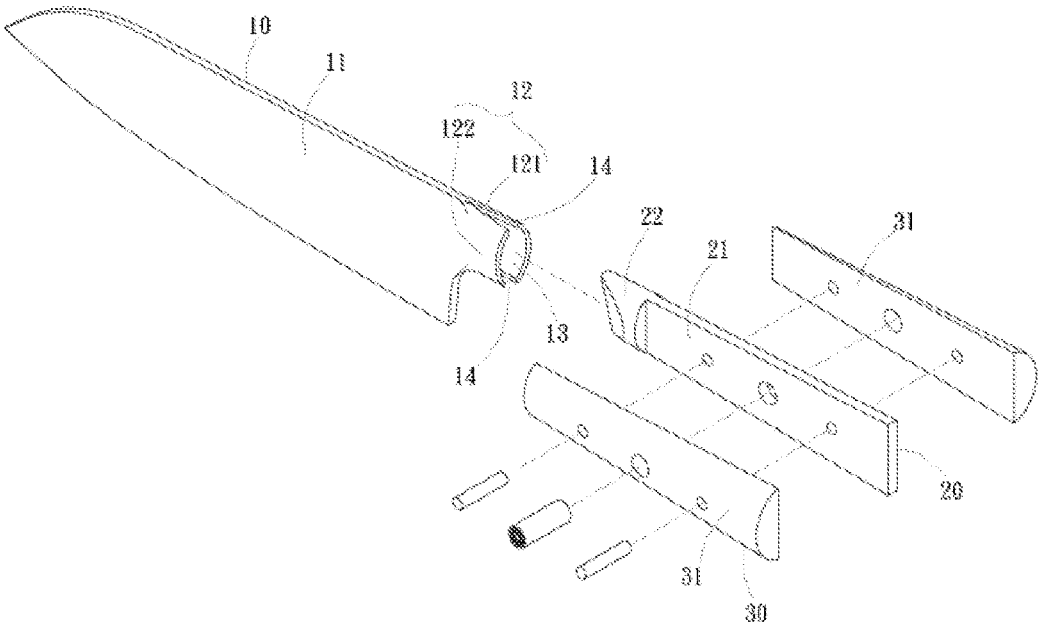
FIG. 2 is a rear exploded view of a pattern knife assembly in accordance with a preferred embodiment of the present invention.

With reference to FIGS. 1 and 2 for a pattern knife assembly in accordance with a preferred embodiment of the present invention, the pattern knife assembly comprises a blade portion 10, and a tang portion 20 coupled to a rear end of the blade portion 10, and the tang portion 20 is combined with a handle 30 to form a pattern knife, and the pattern knife assembly may be applied to cooking knives, collection knives, or knives of any other purpose.

The blade portion 10 is a steel component manufactured by a forging process, so that the blade portion 10 has a sheet blade 11 having a surface grain made of a pattern steel (such as a Damascus pattern) and manufactured by the forging process or any other manufacturing process, and integrally formed and coupled to a connecting sleeve 12 at the rear end of the blade 11, and a sheathing hole 13 concavely formed in a direction from the rear end of the connecting sleeve 12 to a tip of the blade 11.

The tang portion 20 is a steel component manufactured by a casting or cutting process instead of the forging process which is used for manufacturing the blade portion 10, wherein the casting or cutting process is used to manufacture the tang portion 20 having a tang 21 hidden in the handle 30 and integrally coupled to a connector 22 at the front end of the tang 21, wherein the tang 21 is a sheet body, and the connector 22 has a width greater than the block of the tang 21 and a size suitably inserted into the sheathing hole 13.

Figure 3:
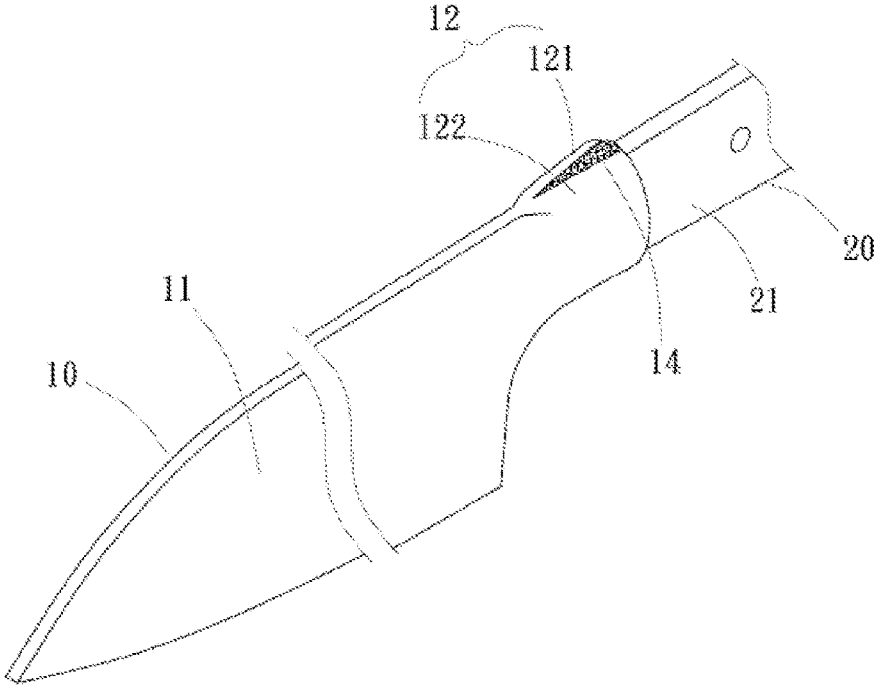
FIG. 3 is a partial blowup view of a welded pattern knife assembly of the present invention.
Figure 4:
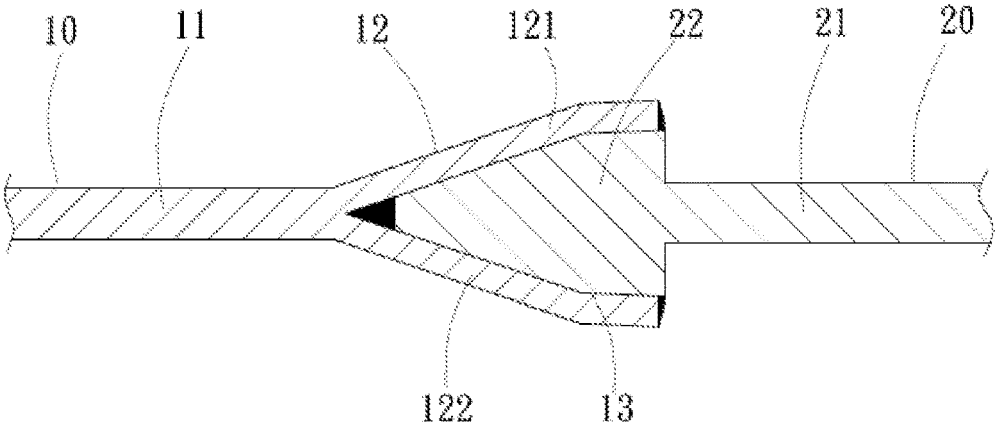
FIG. 4 is a partial blowup view of a welded pattern knife assembly of the present invention.
Figure 5:
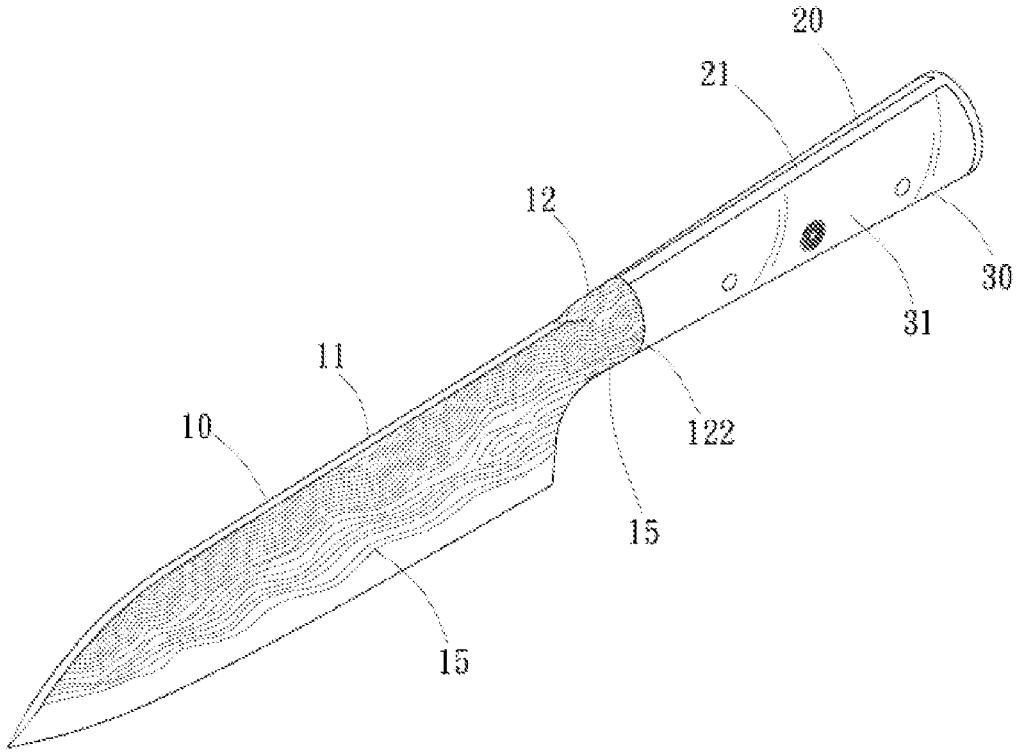
FIG. 5 is a schematic view of a pattern knife product manufactured according to a pattern knife assembly of the present invention.

With reference to FIGS. 3 and 4, when the blade portion 10 and the tang portion 20 are combined into a knife embryo, the connector 22 of the tang portion 20 is inserted into the sheathing hole 13 of the connecting sleeve 12 at the rear end of the blade portion 10, so that the connecting sleeve 12 covers the connector 22, and the connecting sleeve 12 is welded with the connector 22, and the cervices formed and remained after the welding process are filled by a laser hot-melting process, so that the connecting sleeve 12 forms a surface capable of covering the connector 22 completely. When the tang 21 is assembled to the handle 30, the rear end of the connecting sleeve 12 is coupled to (or abutted against) the front end of the handle 30 (as shown in FIG. 5), so that the handle 30 of the steel knife is formed with a bolster forged by steel and formed at the front end of the handle 30 (which is the connecting sleeve 12).

In FIGS. 1 and 2, both upper and lower sides of the connecting sleeve 12 at the rear end of the blade portion 10 have a slot 14 extended in a direction from the rear end of the connecting sleeve 12 toward the tip of the blade 11, and the slot 14 divides the connecting sleeve 12 into left and right sleeve plates 121, 122, so that the sheathing hole 13 is formed between the left and right sleeve plates 121, 122. When the tang portion 20 is combined with the blade portion 10 as shown in FIGS. 4 and 5, the connector 22 of the tang portion 20 is inserted into the sheathing hole 13 between the left and right sleeve plates 121, 122, and the left and right sleeve plates 121, 122 are welded to the connector 22, and then the cervices formed and remained after the welding process are filled by a laser holt-melting process, so that the connecting sleeve 12 forms a surface capable of covering the connector 22 completely.

In the manufacture of the structure having the slot 14 formed on the connecting sleeve 12 at the rear end of the blade portion 10 and the left and right sleeve plates 121, 122, the blade 11 of the blade portion 10 is forged into a sheet, and a linear cutting process is performed at the rear end of the blade 11, and one of the aforementioned slots 14 is cut and formed longitudinally in a direction from the rear end of the blade 11 toward the tip of the blade 11, so as to form the left and right sleeve plates 121, 122, and then the left and right sleeve plates 121, 122 are forged or stamped into the shape of a section to form the sheathing hole 13. Specifically, the left and right sleeve plates 121, 122 may be forged or stamped into symmetrical arc plates, and the sheathing hole 13 forms an arc inner hole wall (as shown in FIG. 2).

The tang portion 20 is a steel component manufactured by a casting or cutting process. Preferably, the tang 21 of the tang portion 20 is a full-keel sheet, and the connector 22 is a section which is a block same as the section of the sheathing hole 13. In detail, the connector 22 is manufactured and formed at the front end of the tang 21 according to the shape and size of the section of the sheathing hole 13, so that the connector 22 and the sheathing hole 13 are matched and can be combined with each other. For example, when the sheathing hole 13 is formed into an arc inner hole wall, both sides of the connector 22 of the tang portion 20 are arc sides configured to be corresponsive to the inner hole wall of the sheathing hole 13, so as to provide a tight welded assembly.

In FIGS. 1, 2 and 5 for a preferred embodiment of the handle 30, the handle 30 comprises two grips 31 for clamping both sides of the tang 21, so that the front end of the two grips 31 abuts against the rear of both sides of the connector 22 of the tang portion 20 and the rear side of the connecting sleeve 12 of the blade portion 10, and a steel knife with a section of a forged handle head (which is the connecting sleeve 12) is formed at the front end of the handle 30.

With the technology of the pattern knife assembly of the present invention, a knife embryo can be produced quickly and the assembly is assembled securely by the welded structure of the connecting sleeve 12 at the rear end of the blade portion 10 and the connector 22 at the front end of the tang portion 20, and the connector 22 is inserted into the sheathing hole 13 at the rear end of the connecting sleeve 12. With the technology of the aforementioned assembly, the blade portion 10 as shown in FIG. 5 can be extended to a surface of the connecting sleeve 12 due to the surface grain 15 (such as Damascus pattern) of the pattern steel formed by the forging process (or any other manufacturing process), so that the surface pattern can be shown completely on the surface of the connecting sleeve 12 in 360 degrees, and the steel portion (or the bolster portion) of the whole steel knife exposed from the handle 30 shows the surface grain 15 of the pattern steel. It is noteworthy that the assembly including the tang 21 and the handle 30 of the present invention is not limited to the full-keel type only. As long as the width of the tang 21 is reduced, a tang of the through handle type may be used to achieve the same effect.

While the invention has been described by means of specific embodiments, numerous modifications and variations could be made thereto by those skilled in the art without departing from the scope and spirit of the invention set forth in the claims.

What is claimed is:

1. A pattern knife assembly, comprising:

a blade portion having a sheet blade, a connecting sleeve integrally coupled to a rear end of the sheet blade, and a sheathing hole concavely formed in the direction from a rear end of the connecting sleeve toward a tip of the blade; and a tang portion having a tang hidden in a handle, a connector integrally coupled to a front end of the tang, and the connector having a width greater than the tang;

and the connector of the tang portion being inserted into the sheathing hole of the connecting sleeve, and the connecting sleeve and the connector being welded to each other, and the connecting sleeve being coupled to a front end of the handle.

2. The pattern knife assembly of claim 1, wherein the connecting sleeve has an upper side and a lower side, and a slot is formed and extended in a direction from the rear end of the connecting sleeve toward the tip of the blade for dividing the connecting sleeve into left and right sleeve plates, and the sheathing hole is formed between the left and right sleeve plates, and the connector of the tang portion is inserted into the sheathing hole between the left and right sleeve plates, and the left and right sleeve plates are welded to the connector.

3. The pattern knife assembly of claim 1, wherein the tang of the tang portion is a sheet, and a section shape of a block of the connector of the tang portion and a section shape of the sheathing hole are matched.

4. The pattern knife assembly of claim 2, wherein the tang of the tang portion is a sheet, and a section shape of a block of the connector of the tang portion and a section shape of the sheathing hole are matched.

5. The pattern knife assembly of claim 1, wherein the connecting sleeve is divided into left and right sleeve plates, and the left and right sleeve plates are bent into symmetrical arc plates, and the sheathing hole is formed into an arc inner hole wall, and both sides of the connector of the tang portion are configured to be corresponsive to the arc inner hole wall of the sheathing hole.

6. The pattern knife assembly of claim 2, wherein the left and right sleeve plates are bent into symmetrical arc plates, and the sheathing hole is formed into an arc inner hole wall, and both sides of the connector of the tang portion are configured to be corresponsive to the arc inner hole wall of the sheathing hole.

7. The pattern knife assembly of claim 1, wherein the handle includes two grips for clamping opposing sides of the tang, and a front end of the two grips abuts a rear end of the connector and the rear end of the connecting sleeve.

8. The pattern knife assembly of claim 2, wherein the handle includes two grips for clamping opposing sides of the tang, and a front end of the two grips buts a rear end of the connector and the rear end of the connecting sleeve.

9. The pattern knife assembly of claim 1, wherein the blade portion has a blade surface with a pattern formed thereon, and the pattern is distributed onto an outer surface of the connecting sleeve.

10. The pattern knife assembly of claim 2, wherein the blade portion has a blade surface with a pattern formed thereon, and the pattern is distributed onto an outer surface of the connecting sleeve.

* * * * *